US009874020B2

(12) United States Patent
Moore

(10) Patent No.: US 9,874,020 B2
(45) Date of Patent: Jan. 23, 2018

(54) ICE MELTING AND CLEARING ROOF ROD

(71) Applicant: Carl S. Moore, Sterling, MA (US)

(72) Inventor: Carl S. Moore, Sterling, MA (US)

( * ) Notice: Subject to any disclaimer, the term of this patent is extended or adjusted under 35 U.S.C. 154(b) by 0 days.

(21) Appl. No.: 14/678,655

(22) Filed: Apr. 3, 2015

(65) Prior Publication Data

US 2016/0289973 A1 Oct. 6, 2016

(51) Int. Cl.
*E04F 13/10* (2006.01)
*E04D 13/10* (2006.01)

(52) U.S. Cl.
CPC ..... *E04D 13/103* (2013.01); *E04D 13/106* (2013.01)

(58) Field of Classification Search
CPC ..... E04D 13/103; E04D 13/106
USPC ..... 52/741.1
See application file for complete search history.

(56) References Cited

U.S. PATENT DOCUMENTS 1,857,883 A * 5/1932 Sjolander ..... E04D 13/103 15/250.03
4,261,417 A * 4/1981 Tingley ..... E04D 13/103 126/569
6,282,846 B1 * 9/2001 Nocella ..... E04D 13/0762 119/51.03
6,772,543 B2 8/2004 Kassouni
2005/0193637 A1 * 9/2005 Petroff ..... E04D 13/103 52/11
2006/0054720 A1 3/2006 Valiton et al.
2006/0231575 A1 * 10/2006 Sroufe ..... E04D 13/106 222/174
2008/0184564 A1 * 8/2008 Fagan ..... B26B 29/02 30/169
2013/0048029 A1 2/2013 Vercouteren

FOREIGN PATENT DOCUMENTS

EP 0787428 * 8/1997

* cited by examiner

*Primary Examiner* — Brian Glessner
*Assistant Examiner* — Adam Barlow
(74) *Attorney, Agent, or Firm* — Genius Patent APC
Bruce Hare

(57) ABSTRACT

An ice melting and clearing rod includes an ice melting chemical compound including calcium chloride, sodium chloride, potassium chloride, amide, and/or glycol, forming a substantially cylindrical member. The substantially cylindrical member includes: an outer surface including: multiple grooves that run along a length of the cylindrical member, the grooves being evenly spaced about a circumference of the cylindrical member; and a textured surface along at least a portion of the outer surface, the textured surface providing resistance in one direction along the length of the cylindrical member; and a set of through-holes adapted for use as placement features, wherein each through-hole in the set of through-holes is perpendicular to the length of the cylindrical member, where: the rod is adapted for use on a sloped roof, the outer surface is formed by the ice melting compound, and a shape of the substantially cylindrical member is retained without any external container.

1 Claim, 6 Drawing Sheets

ICE MELTING AND CLEARING ROOF ROD

BACKGROUND

In many areas, temperatures may drop below freezing for extended periods. In addition, such areas may be subject to precipitation (such as snow or freezing rain) that may build up on the roofs of various structures. Such structures may typically be heated (and/or have heat absorbing elements such as black shingles) that may cause built up snow to thaw and re-freeze such that an ice dam is created.

Ice dams are ridges of ice that form at the edge of a roof and prevent water from melting snow (and/or ice) to drain off the roof. Water may back up behind the ice dam and leak into a home, causing damage to walls, ceilings, insulation, etc.

Existing solutions utilize ice-melting compounds in forms such as loose granular pieces and formed puck-shaped products. Loose granular compounds may not stay at a particular location as water may carry the grains to other locations. Maintaining the position of the grains using items such as socks or other containers is cumbersome and requires future removal of the containers. Puck-shaped melt products may pool melting water at the puck location without providing a path over or through the ice dam. In addition, a puck-shaped product may unnecessarily limit the surface area of exposed melting compound.

Thus there is a need for an ice melting and clearing solution that maximizes the surface area of a melting compound, retains a position, and provides a channel for drainage through an ice dam.

SUMMARY

Some embodiments provide an ice melting and clearing roof rod. The rod may be substantially cylindrical. Alternatively, different embodiments may have different shapes (e.g., circular, rectangular, triangular, etc.) that extend along a length of rod.

The roof rod may include various ridges and/or grooves that provide additional surface area compared to a smooth finish. In some embodiments, the roof rod may include one or more placement features (e.g., through-holes) that may allow the rod to be positioned as desired on a roof of a structure.

Alternatively to or conjunctively to the shapes extending along the length of the rod, the roof rod may have textures or patterns that modify the depth of such shapes along the length of the rod (e.g., fish-scale or saw tooth patterns). Such textures and/or patterns may allow the rod to retain a position along a roof or other structural element.

The roof rod may include various appropriate ice-melting materials. The roof rod may melt ice or snow in contact with the rod. The roof rod may create a channel that allows water to flow along the rod and past any ice dams.

The preceding Brief Summary is intended to serve as a brief introduction to various features of some exemplary embodiments of the invention. Other embodiments may be implemented in other specific forms without departing from the spirit of the invention.

BRIEF DESCRIPTION OF THE SEVERAL VIEWS OF THE DRAWINGS

The novel features of the invention are set forth in the appended claims. However, for purpose of explanation, several embodiments of the invention are illustrated in the following drawings.

DETAILED DESCRIPTION

The following detailed description describes currently contemplated modes of carrying out exemplary embodiments of the invention. The description is not to be taken in a limiting sense, but is made merely for the purpose of illustrating the general principles of the invention, as the scope of the invention is best defined by the appended claims.

Various inventive features are described below that can each be used independently of one another or in combination with other features. Broadly, some embodiments of the present invention generally provide an ice melting and clearing roof rod.

Such a rod may include various appropriate materials (e.g., calcium chloride, sodium chloride, amide, potassium chloride, etc.) that may be used alone or as a mixture of multiple such materials. In addition, various other materials may be used when manufacturing the rods or included in final products as appropriate. For instance, some embodiments may use a modified amide and glycol admixture.

Some embodiments may include colored elements such that a user is able to see a visual indication of melting snow and ice and/or drainage channels provided by the rods. Such colors may be able to be washed away (and/or dissipate as water drains away, be dispersed during rainfall, etc.).

The "rods" may be formed into various appropriate shapes, as described in further detail below.

Figure 1:
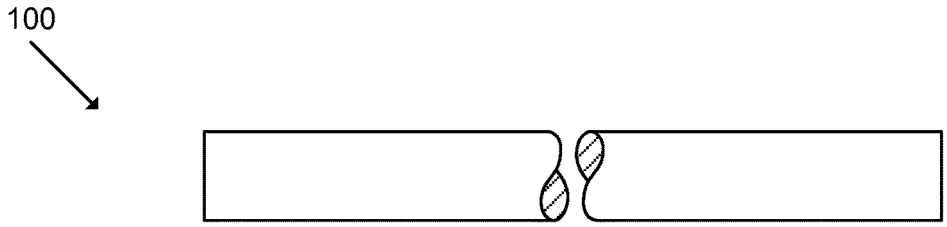
FIG. 1 illustrates a front elevation view of an ice melting and clearing roof rod according to an exemplary embodiment of the invention.

FIG. 1 illustrates a front elevation view of an ice melting and clearing roof rod 100 according to an exemplary embodiment of the invention. As shown, the rod may be a solid cylinder.

The rods may be formed in various appropriate ways. For instance, various ice melting materials may be mixed together along with other elements (e.g., water, bonding or forming agents, etc.) and placed in a mold until the mixture has solidified. Alternatively, a dough-like mixture may be pressed through a form or otherwise extruded such that rods may be formed.

The rods may be sized in various appropriate ways and depending on various relevant factors. For instance, different combinations of materials may induce structural limitations (e.g., minimum radius needed to support a particular length of rod, maximum length at a given radius, etc.). As one example, each rod may have a diameter of one inch to two inches and a length of six inches to twelve inches.

In addition, the amount of material in each rod may be determined in various appropriate ways and may depend on various relevant factors. For instance, environmental concerns or regulations may limit amounts of certain materials used in the rods. As another example, differently sized rods may be provided for use on differently sized structures. As still another example, the rods may be sized such that multiple rods may be able to be placed into a storage container with particular dimensions or other limitations (e.g., maximum weight) to facilitate transportation and/or use.

The length and radius of the cylinder may be selected to maximize the surface area provided by a particular volume of ice melting material. For instance, existing solutions may utilize puck-shaped melting elements (e.g., a cylinder having a diameter of three inches and a height or length of one inch) that provide limited surface area and thus limit the potential to melt snow or ice contacted by the melting element. In contrast, the same amount of material may be formed into a rod with a radius of one inch and a length of nine inches, for example, where such a configuration increases the surface area by a factor of three.

Figure 2:
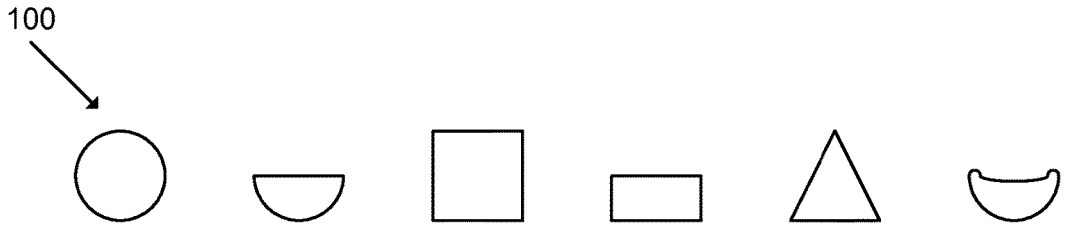
FIG. 2 illustrates end views of multiple roof rods of some embodiments

FIG. 2 illustrates end views of multiple roof rods 100 of some embodiments. As shown, the rods may be cylinders with a round end shape. As other examples, the end shapes of the rods may be semicircles, squares or rectangles, triangles, canoe-shaped, etc. The shape may be selected based on various relevant factors (e.g., ease of manufacturing, structure type, user type, etc.).

Figure 3:
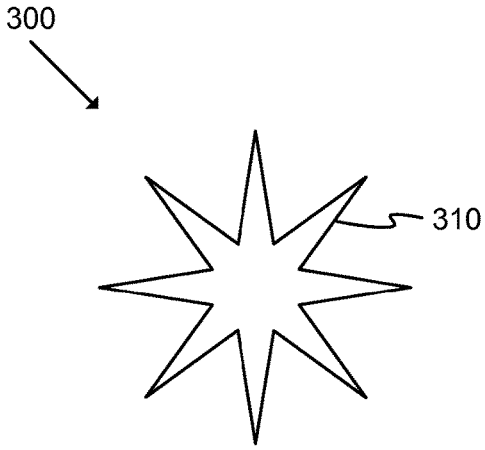
FIG. 3 illustrates an end view of a star-shaped roof rod with increased surface area of some embodiments.

FIG. 3 illustrates an end view of a star-shaped roof rod 300 with increased surface area of some embodiments. As shown, the rod may have multiple protruding points 310 situated about the outside surface of the rod 300 such that the ridges 310 run along the length of the rod 300. Different embodiments may include different numbers of points 310 that may be arranged in different ways (e.g., with spaces between points, with points of different height, etc.). In addition, the points may be shaped differently than shown (e.g., at least partially curved, with squared or rounded ends for safety, etc.). Depending on the dimensions of the points, the surface area of such a rod 300 may be increased by a factor of five or more over a cylindrical shape.

Figure 4:
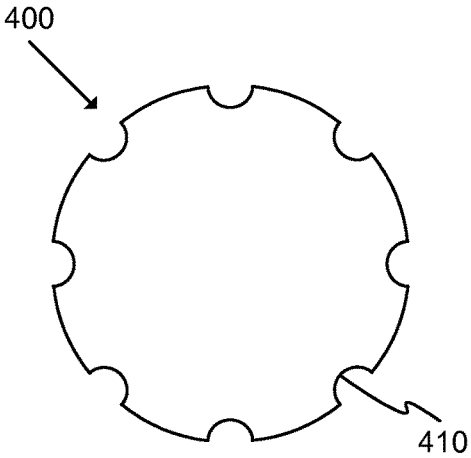
FIG. 4 illustrates an end view of a grooved roof rod with increased surface area of some embodiments.

FIG. 4 illustrates an end view of a grooved roof rod 400 with increased surface area of some embodiments. As shown, the surface of the rod may include multiple grooves 410. Different embodiments may include different numbers of grooves, differently sized and/or shaped grooves, and/or otherwise differently arranged grooves.

In addition to the increased surface area provided by rods 300 and 400, the grooves 410 or valleys between the points 310 may also provide water drainage paths for melting snow and ice. The addition points or edges may also provide traction for the rod to be held in place on a slippery surface.

Furthermore, in addition to the textures provided by the example rods 300 and 400, some embodiments may have a texture the runs along the length of the rod. For instance, some embodiments may include a saw tooth shaped surface that may allow the rod to hold a position on a slippery surface as well as providing additional surface area. Such a textured surface may be used in conjunction with any of the rod shapes described above in reference to FIGS. 2-4.

In some embodiments, the roof rod may include a combination of ridges and grooves (and/or other appropriate features). The ridges and grooves may be arranged in various different ways. For instance, some embodiments may include ridges along a "bottom" surface of a rod and grooves along a "top" surface (relative to placement on a roof). In this way, the rod may be at least partially secured to ice or snow on a roof by the protruding ridges, while the grooves on the top surface may facilitate melting and clearing of additional precipitation that occurs after the rods have been placed on a roof.

Figure 5:
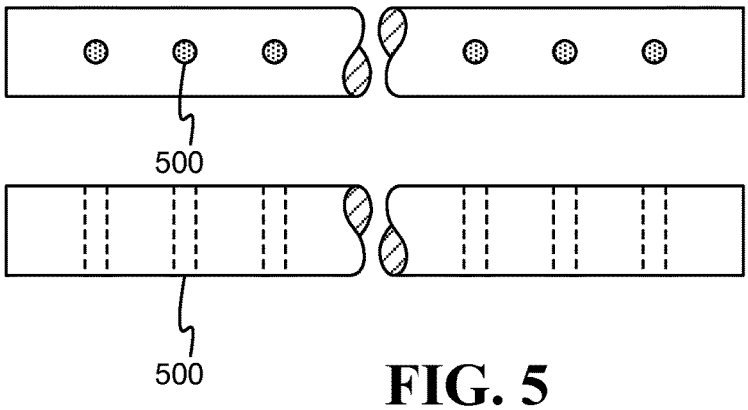
FIG. 5 illustrates front and side elevation views of the roof rod of FIG. 1 with placement features of some embodiments.

FIG. 5 illustrates front and side elevation views of the roof rod 100 with placement features 500 of some embodiments. Different embodiments may include different numbers of placement features that may be placed at various appropriate locations (e.g., a single placement feature, a placement feature at each end, placement features evenly spaced along the rod, etc.).

In this example, the placement features are through-holes, but different embodiments may include different placement features. For instance, the shape of the feature may be different (e.g., square, triangular, notched, etc.). As another example, the depth of the feature may be different (e.g., halfway through a rod, a specified depth into a rod, etc.). Some embodiments may include multiple types of placement features (e.g., a through-hole and a notched triangle). The placement features may be used with any of the rods described above in reference to FIGS. 1-4.

The placement features 500 may be able to receive a placement tool. Such a tool may include a pole or similar element with a protruding hook (or nail, key, etc.). The protruding hook may be sized or shaped to correspond to particular types of placement features (e.g., a round wire or hook for a through-hole feature, a triangular or square end sized to fit within a similarly shaped feature, etc.). In some embodiments, the placement tool may include a releasable catch or other appropriate feature that may allow a user to securely attach a rod, position the rod, and then detach the rod at a desired location.

In addition to allowing placement of the rods 100, the placement features 500 may provide additional drainage channels for water from melting ice and snow.

Figure 6:
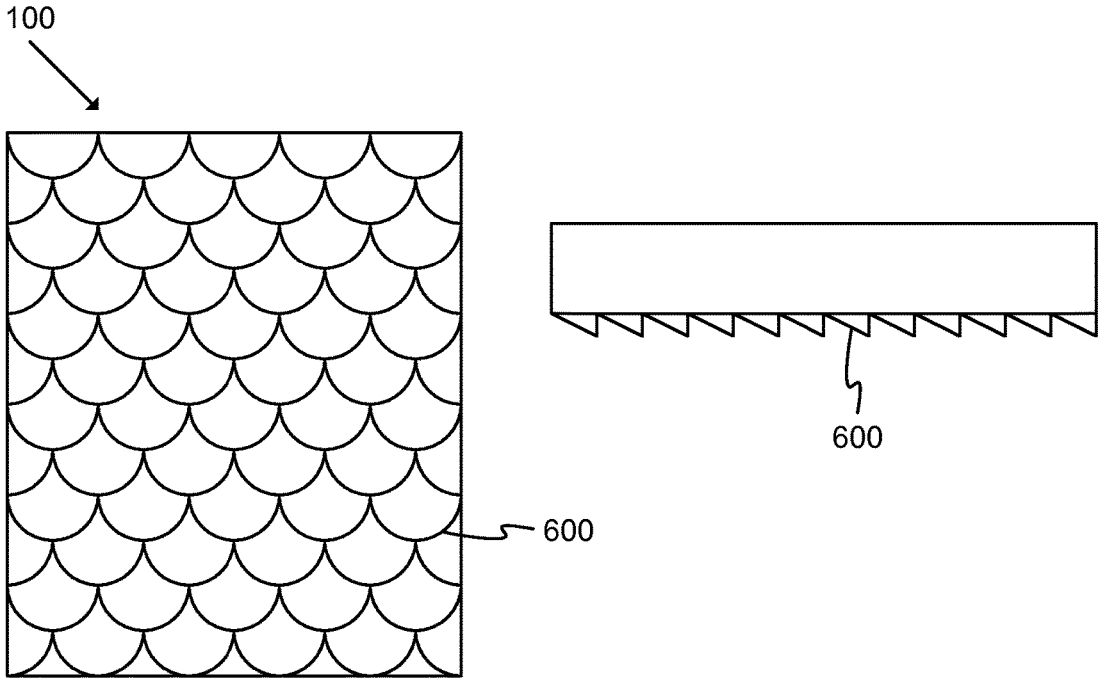
FIG. 6 illustrates front and side elevation views of a surface texture used by some embodiments of the roof rod of FIG. 1.

FIG. 6 illustrates front and side elevation views of a surface texture used by some embodiments of the roof rod 100. In this example, a number of "scales" 600 dispersed about the surface may allow the rod to move freely in one direction and provide grip and traction in the opposite direction. Different embodiments may include different arrangements of textured surfaces. For instance, cylindrical embodiments may include scales surrounding the entire outer wall surface of the cylinder. As another example, a rectangular rod may include textured areas at each end on a bottom side of the rod.

Different embodiments may include different textures. For example, some embodiments may include triangle or saw too shaped textures. As another example, some embodiments may include evenly spaced protruding spikes.

Figure 7:
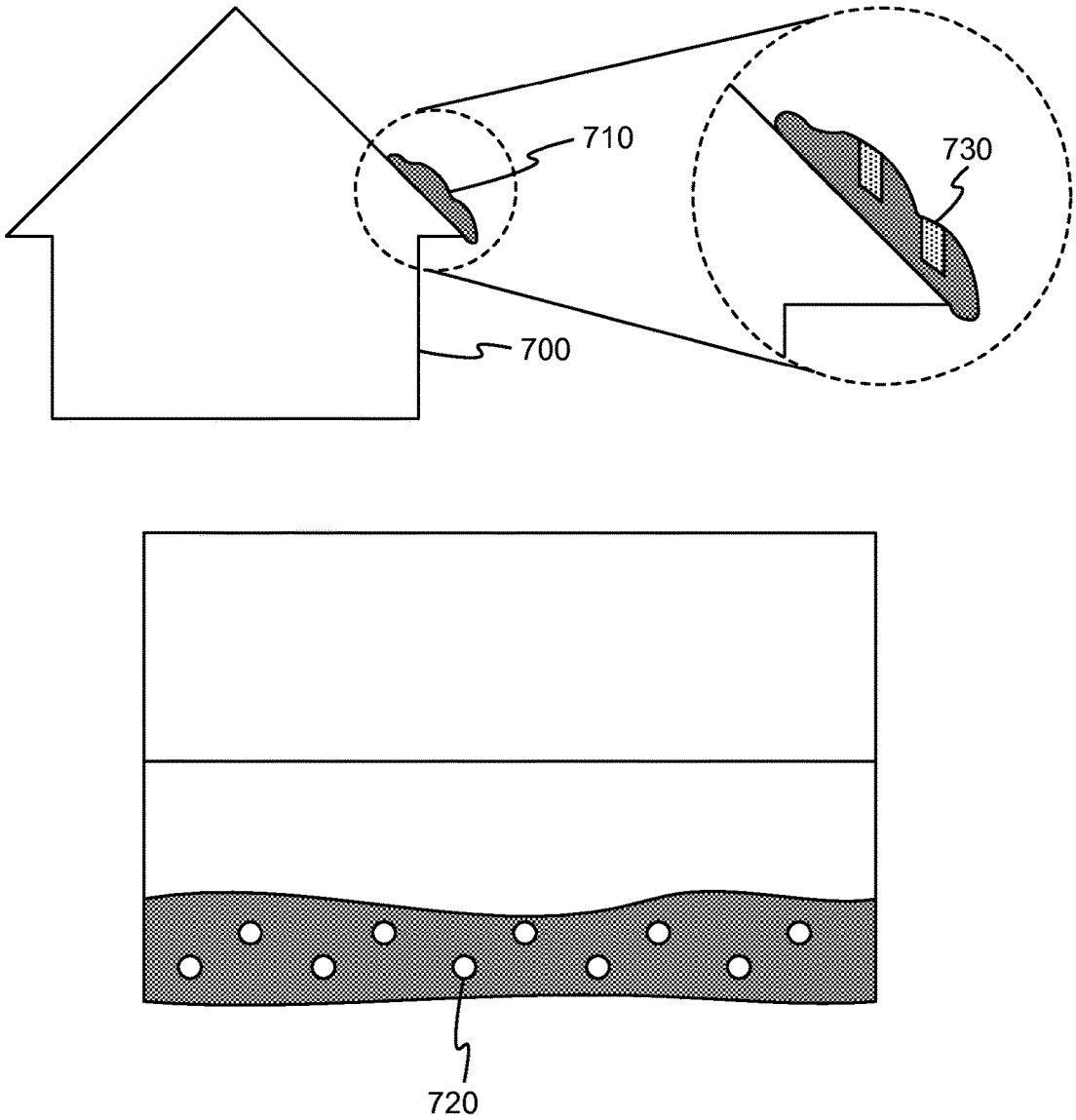
FIG. 7 illustrates side elevation and top views of a structure with an associated ice dam.

FIG. 7 illustrates side elevation and top views of a structure 700 with an associated ice dam 710. In this example, puck-type melting elements 720 may create cavities 730 in the ice dam 710 that retain water and are not able to maximize the amount of ice or snow that is able to melt and be cleared away from the roof of the house 700.

Figure 8:
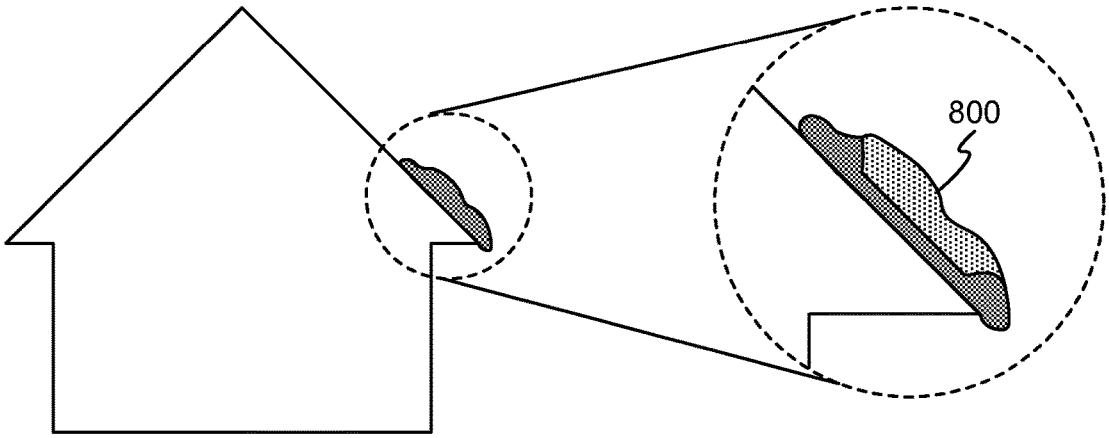
FIG. 8 illustrates side elevation and top views of a house with multiple deployed roof rods of FIG. 1 during use.
Figure 8:
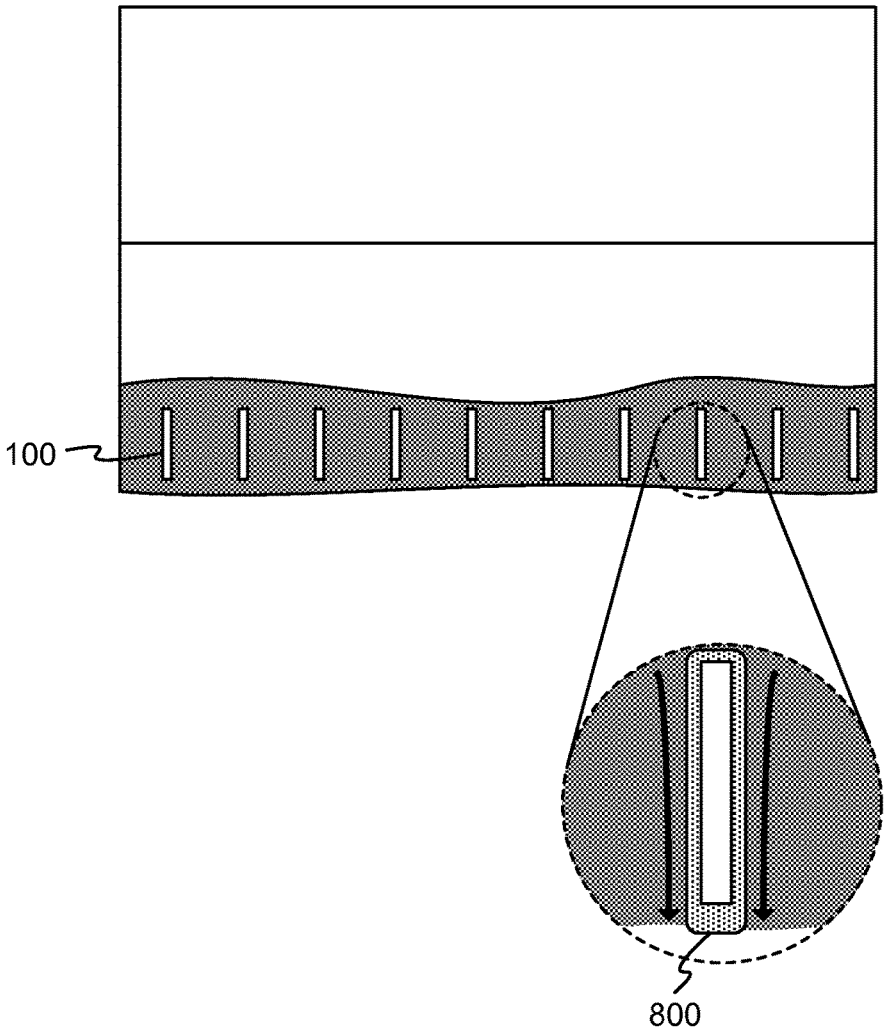

FIG. 8 illustrates side elevation and top views of a house with multiple deployed roof rods 100 during use. As shown, each roof rod may be able to create a cavity 800 that provides a flow channel through the ice dam 710. Water may thus be able to flow along the surface of each rod 100 within the channel 800 such that the melting ice and snow is able to pass over or through the ice dam.

One of ordinary skill in the art will recognize that the above examples are provided for descriptive purposes and different embodiments may be implemented in various different ways without departing from the spirit of the invention.

Figure 9:
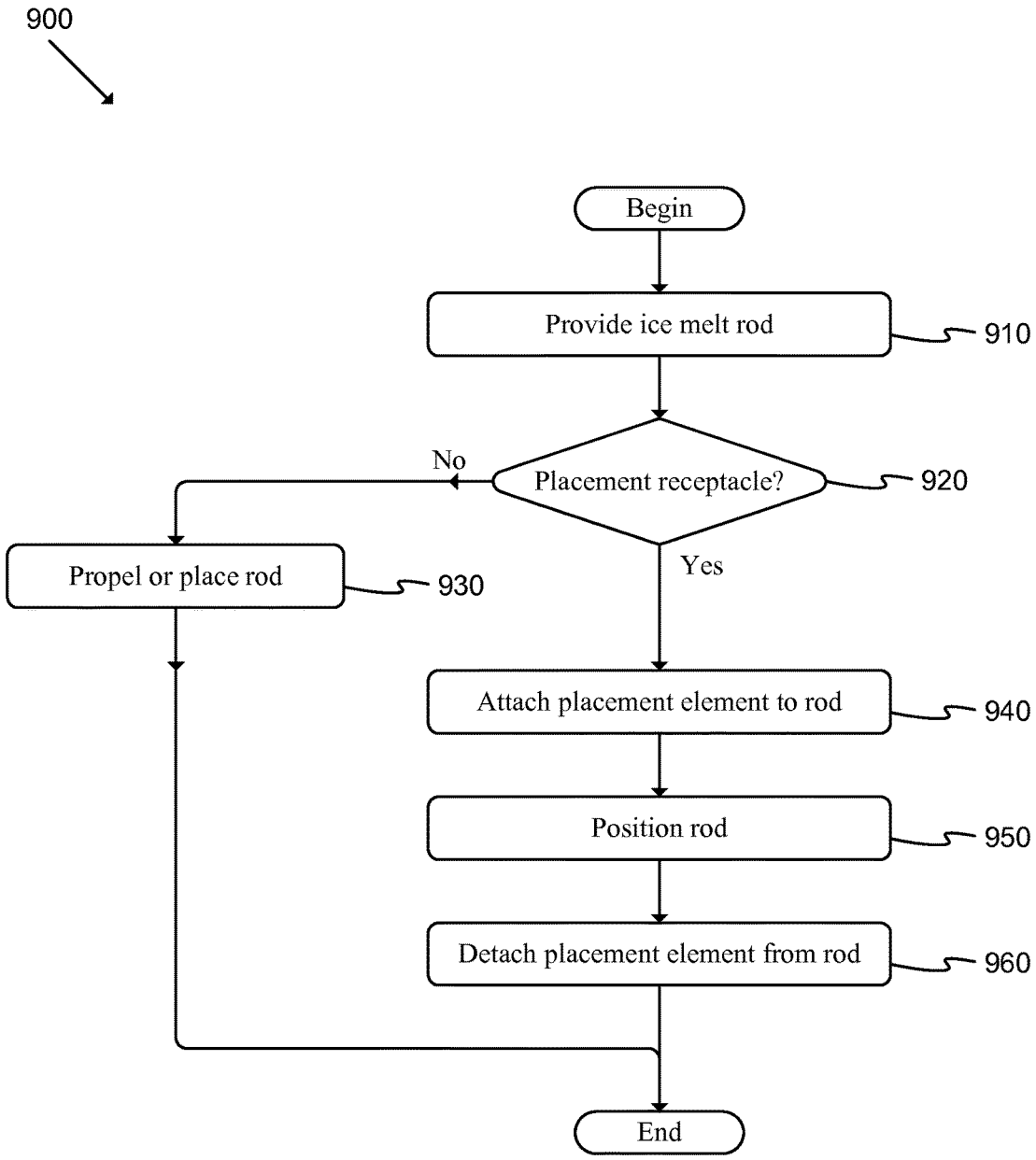
FIG. 9 illustrates a flow chart of a conceptual process used by some embodiments to place the roof rod of FIG. 1.

FIG. 9 illustrates a flow chart of a conceptual process 900 used by some embodiments to place roof rod 100. Such a process may begin, for instance, after an ice dam is formed. Alternatively, such rods may be placed prior to ice or snow accumulation as a preventive measure.

As shown, the process may provide (at 910) an ice melt roof rod. As described above, the rod may be provided in various different shapes, sizes, etc., as appropriate for any particular application. Next, the process may determine (at 920) whether a placement receptacle (or placement feature) is available and/or whether the receptacle will be used. Such a determination may be made based on various relevant factors (e.g., user preference, type of rod, etc.).

If the process determines (at 920) that no placement receptacle will be used, the process may propel or place (at 930) the rod into the desired location and then may end. For instance, a user may throw a rod into place or drop or otherwise place a rod on a surface using a ladder or other appropriate access.

If the process determines (at 920) that a placement receptacle may be used, the process may then attach (at 940) the placement element (or placement tool) to the rod. As described above, such a placement tool may be a pole with a protruding hook or nail that is able to engage the placement receptacle. The process may then position (at 950) the rod (e.g., by lifting the rod into place using the placement tool), detach (at 960) the placement tool from the rod (e.g., by twisting or otherwise manipulating the tool), and then may end.

One of ordinary skill in the art will recognize that process 900 may be performed in various different ways without departing from the spirit of the disclosure. For instance, the operations may be performed in a different order than shown. As another example, additional operations may be included or some listed operations may be omitted. In some embodiments, the process (or portions thereof) may be performed iteratively. The process may be performed as part of a larger macro process or divided into multiple sub-processes.

Figure 10:
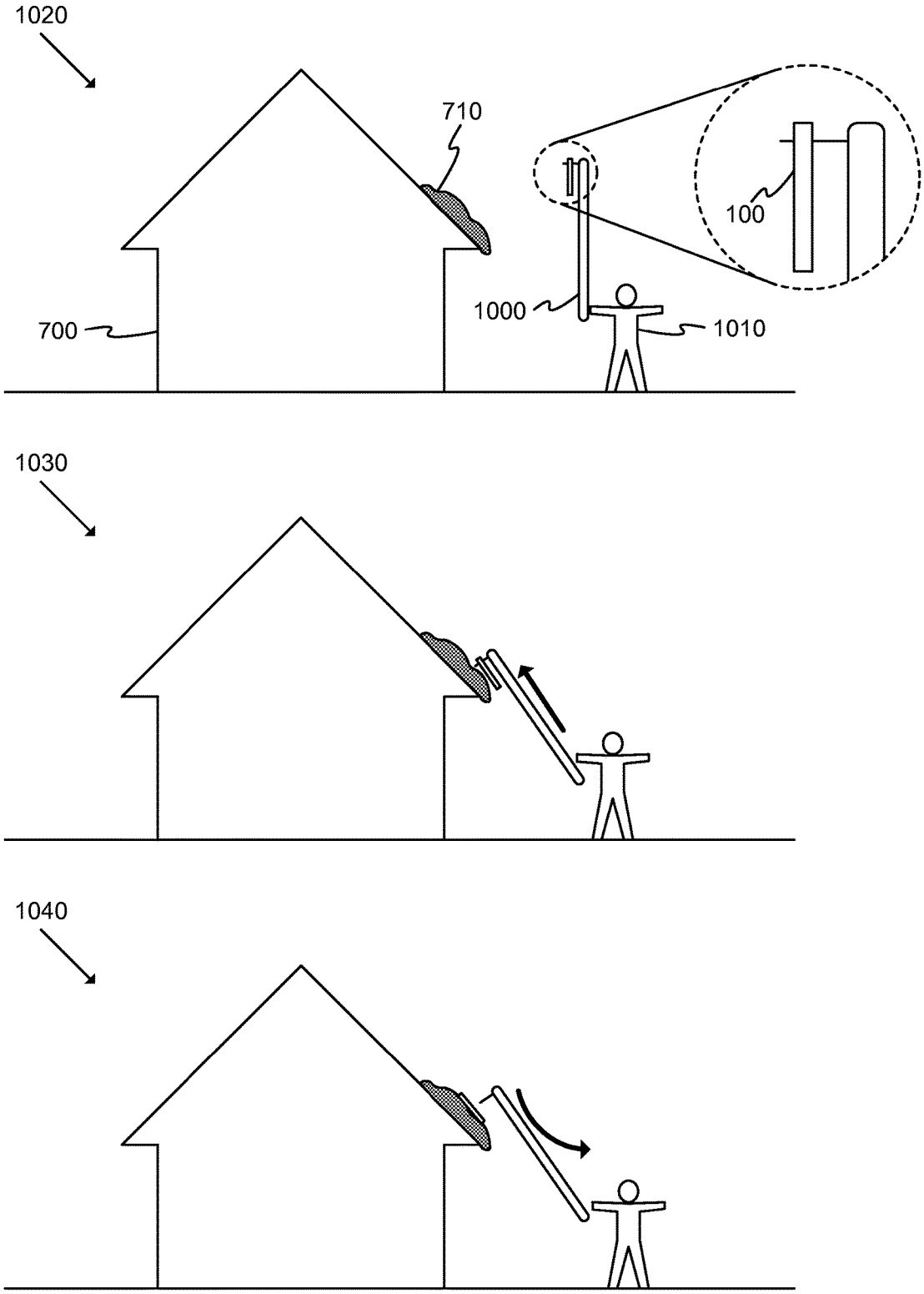
FIG. 10 illustrates side elevation views of roof rod deployment using a placement tool of some embodiments.

FIG. 10 illustrates side elevation views of roof rod deployment using a placement tool 1000 of some embodiments. Such a tool may include a pole or similar element, a hook, nail, or key, and/or other appropriate elements (e.g., hand grips, release trigger, etc.).

In a first example view 1020, a user 1010 has attached a roof rod 100 to the pole by threading a protruding element through the receptacle 200 and/or otherwise engaging the rod 100 with the tool 1000.

In a second example view 1030, the user 1010 manipulates the tool 1000 to position the rod 100 at the desired location along the ice dam 710. If the rod 100 includes textures such as scales 600, the rod 100 may move freely up the slope of the roof as the user 1010 positions the rod.

In a third example view 1040, the user 1010 manipulates the tool 1000 to release the rod 100 at the desired location. If the rod includes textures such as scales 600, the rod 100 may grip the surface of the ice dam 710 and be prevented from sliding down the slope of the roof In such cases, the user 1010 may move the tool 1000 down and away from the rod 100 as indicated.

Alternatively, if no texture is included, the user 1010 may tilt the tool 1000 such that the rod 100 drops into place. Different tools 1000 may include different release features, as appropriate.

The foregoing relates to illustrative details of exemplary embodiments and modifications may be made without departing from the spirit and scope of the disclosure as defined by the following claims.

I claim:

1. An ice melting and clearing rod comprising:

an ice melting chemical compound comprising at least one of calcium chloride, sodium chloride, potassium chloride, amide, and glycol, the ice melting chemical compound forming a substantially cylindrical member, the substantially cylindrical member comprising:

an outer surface of the cylindrical member comprising:

a plurality of grooves that run along a length of the cylindrical member, the plurality of grooves being evenly spaced about a circumference of the cylindrical member; and a textured surface along at least a portion of the outer surface, the textured surface providing resistance in one direction along the length of the cylindrical member; and a set of through-holes adapted for use as placement features, wherein each through-hole in the set of through-holes is perpendicular to the length of the cylindrical member, wherein:

the ice melting and clearing rod is adapted for use on a sloped roof, the outer surface is formed by the ice melting chemical compound, and a shape of the substantially cylindrical member is retained without any external container.

* * * * *